US005660580A

United States Patent [19]

Lehnig

[11] Patent Number: 5,660,580

[45] Date of Patent: Aug. 26, 1997

[54] NOZZLE FOR CRYOGENIC PARTICLE BLAST SYSTEM

[75] Inventor: Tony R. Lehnig, West Chester, Ohio

[73] Assignee: Cold Jet, Inc., Cincinnati, Ohio

[21] Appl. No.: 395,665

[22] Filed: Feb. 28, 1995

[51] Int. Cl.[6] ..... B24B 1/00

[52] U.S. Cl. ..... 451/38; 451/39; 451/40; 451/102; 239/592

[58] Field of Search ..... 951/38, 39, 40, 951/75, 90, 102, 53; 239/21, 584, 592, 654

[56] References Cited

U.S. PATENT DOCUMENTS

| | | | |
|---|---|---|---|
| 4,483,482 | 11/1984 | Junger et al. . | |
| 4,614,237 | 9/1986 | Colodner et al. | 239/289 |
| 5,050,805 | 9/1991 | Lloyd et al. | 239/597 |
| 5,265,383 | 11/1993 | Shank, Jr. | 451/102 |
| 5,390,450 | 2/1995 | Goenka | 451/102 |
| 5,456,629 | 10/1995 | Bingham | 451/102 |

FOREIGN PATENT DOCUMENTS

| | | | |
|---|---|---|---|
| 8900809-A | 3/1989 | Netherlands | 451/102 |

*Primary Examiner*—Robert A. Rose
*Assistant Examiner*—George Nguyen
*Attorney, Agent, or Firm*—Frost & Jacobs

[57] ABSTRACT

A convergent-divergent Single/Multiple Expansion wave contour wall and wave Reflection solid wall Nozzle (S/MERN) for use with particle blast systems is provided which includes a single contoured converging-diverging wall opposing a generally flat, solid wall disposed generally parallel to the direction of the jet flow. The transition from a circular delivery hose to the rectangular throat of the S/MERN nozzle is preferably in only one dimension, with the distance between the side support walls being substantially the same as the diameter of the delivery hose. The S/MERN nozzle relies on reflection from the flat, solid wall for Mach wave expansions, rather than reflections of opposing expansion waves as in conventional nozzles.

30 Claims, 5 Drawing Sheets

NOZZLE FOR CRYOGENIC PARTICLE BLAST SYSTEM

TECHNICAL FIELD

The present invention relates generally to supersonic nozzles and particle blast systems utilizing such nozzles. The invention will be specifically disclosed in connection with Single/Multiple Expansion Reflecting Nozzles as used on particle blast systems which deliver cryogenic particles which sublime on impact.

BACKGROUND OF THE INVENTION

Cryogenic particle blast systems are well known. Systems and the associated component parts are shown in U.S. Pat. Nos. 4,947,592, 5,109,636 and 5,301,509, all of which are incorporated herein by reference. Such systems include a source of cryogenic particles, usually pellets which are typically made of carbon dioxide or any other suitable cryogenic material which preferably sublimes upon impact with the blasting target so that there is no residual particle material to be removed. Such particles are particularly susceptible to degradation due to impacts and direction changes in their flow path. The particles are delivered to a blast nozzle, usually being transported by any suitable transport fluid, typically a gas such as air, carbon dioxide or nitrogen, through a delivery hose. In order to impart as much velocity to the particles to maximize their impact on the blasting target, the exit nozzles are typically converging-diverging supersonic nozzles. Examples of supersonic nozzles are described in U.S. Pat. No. 5,050,805, which is incorporated herein by reference.

The goal of the nozzle is to accelerate the flow, including the entrained particles, to as high a velocity as possible, subject to the design and functional constraints. However, the speed of the transport gas is usually greater than the speed of the entrained particles due to the particles having a mass which is significantly greater than the mass of the gas and being susceptible to decelerating impacts. When the gas and entrained particles are introduced into the entrance of the blast nozzle, the flow transitions from the circular cross-section of the delivery hose to the non-circular cross-section of the blast nozzle. With the conventional prior art converging-diverging blast nozzles, this transition occurs in two dimensions, as the orthagonal dimensions of the nozzle throat were less than the diameter of the delivery hose. In the conventional prior art diverging-converging blast nozzles, the height dimension of the nozzle (i.e., the separation distance of the side support walls) reaches its minimum at the nozzle throat, and remained at its minimum for the length of the nozzle downstream of the throat.

In the conventional prior art converging-diverging blast nozzles, the desire to maximize blast swath width, established by the separation between the diverging nozzle walls, leads to the minimization of the nozzle side wall separation distance. The closeness of the side support walls, maintained downstream of the throat, creates boundary layer viscosity effects which interfere with the proper expansion of the flow, resulting in denigrated flow performance. In such conventional prior art converging-diverging blast nozzles, the constrained particle path movement and associated particle to particle collisions, with the increased side wall viscous turbulence and associated increased particle to nozzle side wall collisions, results in a substantial loss of particle mass. There is also a non-uniform velocity distribution at the exit of the blast nozzle, with the maximum exit velocity occurring at the jet centerline, and lower velocities at either edge of the swath.

In order to attain the desired kinetic energy in conventional prior art diverging-converging blast nozzles, the flow velocity must be increased sufficiently to overcome the deleterious effects of the nozzle design. However, as flow velocity is increased, the particle collisions are increased, and particle mass is decreased further. This results in declining efficiency as flow velocity is increased. It also produces significant increases in noise, which is proportional to velocity to the eighth power. Noise from the blast nozzles is a significant problem, both for the person using the system and for anyone nearby.

In addition to these undesirable functional characteristics of the conventional prior art converging-diverging blast nozzles, there are certain manufacturing constraints which affect not only the cost of producing the nozzles, but the performance of the nozzles. As described below, conventional prior art converging-diverging blast nozzles require symmetry of the opposing diverging walls about the jet centerline, in order for expansion waves to reflect off of the corresponding opposite expansion wave. Attaining and maintaining the necessary symmetry requires that both walls be manufactured to very close tolerances. Deviations from the theoretical symmetrical nozzle results in off design nozzles.

There are other performance related issues associated with conventional prior art converging-diverging blast nozzles. Overexpansion and underexpansion of the nozzles will cause oblique shock waves to occur in the flow. At the operating extremes of overexpanded or underexpanded nozzle flow, a characteristically strong normal type shock wave formation may occur internal or external to the nozzle geometry, respectively. As the delicate entrained particles cross such shock waves, the particles break up.

Additionally, unlike the more customary particle blasting media, such as sand, carbon dioxide particles are significantly more sensitive to self destruction prior to reaching the blasting target. The higher the kinetic energy of the entrained carbon dioxide particles as they pass through the system, the higher the likelihood of particle breakage and mass reduction/sublimation during changes in flow path direction. When a conventional angled nozzle geometry is used for blasting restricted access regions, there is a significant increase in particle break up and reduction in performance attributable to high kinetic energy impacts on the internal nozzle geometry. These performance losses are a direct consequence of not being able to aerodynamically vary the direction of flow exiting from the nozzle from its "in-line" direction.

Thus, there is a need for blast nozzles which can impart significant velocity to particles without excessive loss of particle mass. The exit velocity distribution should be uniform across the entire swath of the exiting flow. The flow direction should be capable of being aerodynamically mined, preserving particle mass. The nozzles need to be quieter and easier and less costly to manufacture than the conventional prior art converging-diverging blast nozzles.

SUMMARY OF THE INVENTION

It is an object of this invention to obviate the above-described problems in shortcomings of the prior art heretofore available.

It is another object of the present invention to provide a particle blast system and nozzle for use therewith with increased particle energy exchange between the transport fluid and the particles.

It is a further object of the present invention to provide a particle blast system and nozzle for use therewith which provide reduced particle degradation over prior art systems and nozzles.

It is yet another object of the present invention to provide a nozzle for use with particle blast systems which produces less noise than prior art nozzles.

It is another object of the present invention to provide a nozzle for use with particle blast systems which performs more closely in accordance with aerodynamic theory and satisfy the boundary constraints of supersonic converging-diverging nozzle aerodynamic theory.

It is still a further object of the present invention to provide to provide a particle blast system and nozzle for use therewith which provide a substantially uniform particle exit velocity across the nozzle exit.

It is yet a further object of the present invention to provide a nozzle for use with particle blast systems which is capable of aerodynamically turning the flow.

It is yet another object of the present invention to provide a nozzle for use with particle blast systems which can be manufactured cheaper and simpler, with less exacting tolerance requirements.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, there is provided a particle blast system with a convergent-divergent Single/Multiple Expansion wave contour wall and wave Reflection solid wall Nozzle (S/MERN). The S/MERN nozzle comprises a single contoured converging-diverging wall opposing a generally flat, solid wall disposed generally parallel to the direction of the jet flow. The transition from a circular delivery hose to the non-circular throat of the S/MERN nozzle is preferably in only one dimension, with the distance between the side support walls being substantially the same as the diameter of the delivery hose. The S/MERN nozzle relies on reflection from the flat, solid wall for Mach wave expansions, rather than reflections of opposing expansion waves as in conventional nozzles.

Still other objects of the present invention will become apparent to those skilled in this art from the following description wherein there is shown and described a preferred embodiment of this invention, simply by way of illustration, of one of the best modes contemplated for carrying out the invention. As will be realized, the invention is capable of other different embodiments, and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification illustrate several aspects of the present invention, and together with the description serve to explain the principles of the invention. In the drawings.

Reference will now be made in detail to the present preferred embodiment of the invention, an example of which is illustrated in the accompanying drawings.

DETAILED DESCRIPTION OF THE PREFERRED EMBODIMENT

Figure 1:
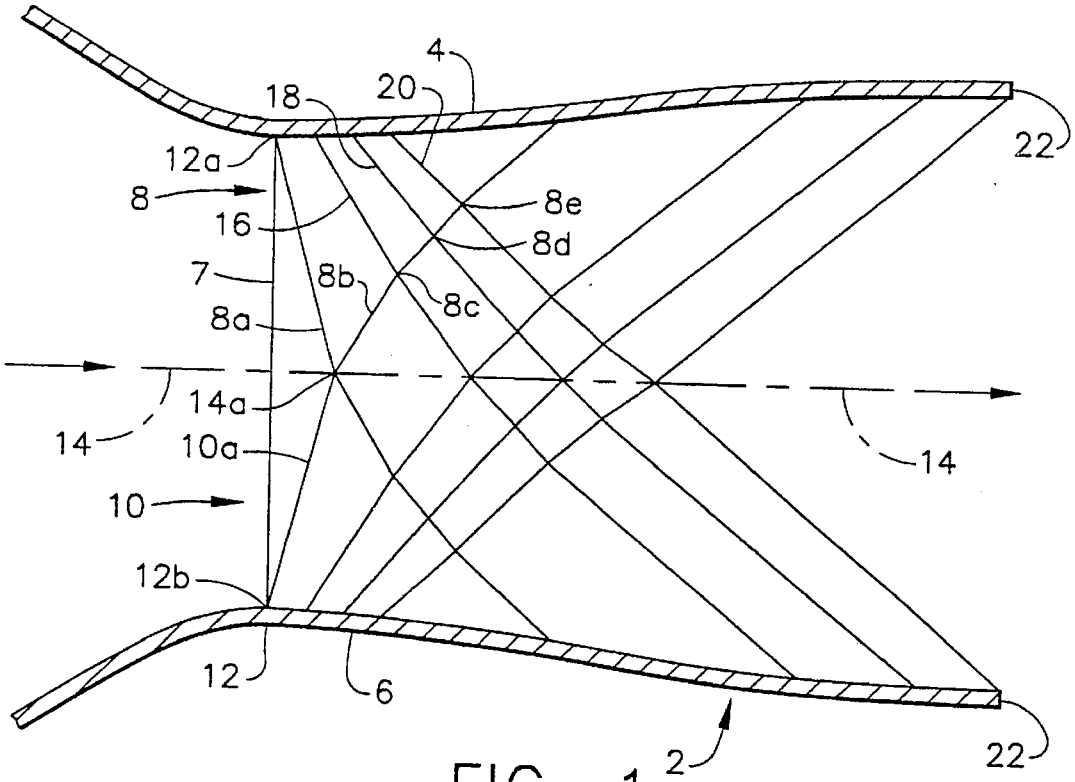
FIG. 1 is diagrammatic, fragmentary cross-sectional view of a conventional prior art converging-diverging blast nozzle, illustrating multiple expansion waves reflecting off of opposing expansion waves.

Referring now to the drawings in detail, wherein like numerals indicate the same elements throughout the views, FIG. 1 is a diagrammatic, fragmentary cross-sectional view of a conventional prior art converging-diverging blast nozzle 2. Nozzle 2 includes spaced apart contoured walls 4 and 6 which create the convergence and divergence of nozzle 2. As is required for supersonic nozzle flow, there is a normal shock 7 located at throat 12. Multiple expansion waves, the first of which is indicated generally at 8, are illustrated reflecting off of opposing expansion waves, the first of which is indicated generally at 10. Waves 8 and 10 begin at throat 12. As is well known, the expansion waves represent a drop in pressure of the flow with an increase in the Mach number. Wave **8*a* is illustrated reflecting off of wave 10*a* at location 14*a* on jet flow centerline 14. Reflected wave 8*b* is shown as changing direction at multiple locations 8*c*, 8*d*, and 8*e*, as wave 8*b* intersects with subsequent (in the direction of flow) waves 16, 18 and 20. Each intersection results in the involved expansion waves changing directions slightly, as illustrated. When wave 8*b* reaches wall 4**, it is reflected again (not shown).

As is well known, expansion waves exist where ever flow constraining geometric expansion, viscous interaction, and surrounding nozzle exit pressure field will favorably allow. If geometric expansion exceeds the driving pressure field, then overexpansion of flow occurs with associated abrupt shock wave induced pressure correction. If the nozzle geometry expansion is less than that required for pressure equilibrium at the nozzle exit, rapid expansion will occur to account for the underexpansion and the jet flow overcorrection to atmospheric pressure will be followed by oblique compression shock waves. Furthermore, if the rate of geometric expansion is axially excessive, viscous interaction may induce flow separation from the nozzle walls.

Ideally, the supersonic nozzle flow pressure field will reduce to exactly match surrounding atmospheric pressure as the flow exits the nozzle; hence, no flow compression shocks or expansion waves will occur. Referring to FIG. 1, the expansion is geometrically cancelled by closing the nozzle divergent wall back down to parallelism with the flow centerline. Thereby, the last expansion wave is canceled at the two-dimension exit position 22. Proper nozzle design therefor requires application of aerodynamic theory.

How closely the actual operation of nozzle 2 approaches the theoretical design operation depends on how precisely symmetrical the opposing walls 4 and 6 are. Variations in the contour and location of corresponding points on walls 4 and 6 result in improper wave expansion and the corresponding expansion waves from each wall not intersecting at centerline 14. Thus, the tolerances of the contours and locations of walls 4 and 6 must be held closely and typically require advanced manufacturing methods. The manufacturing difficulty is compounded not only by the need to manufacture two identical walls, but also by the need to align them precisely to produce the desired expansion wave intersections.

Figure 2A:
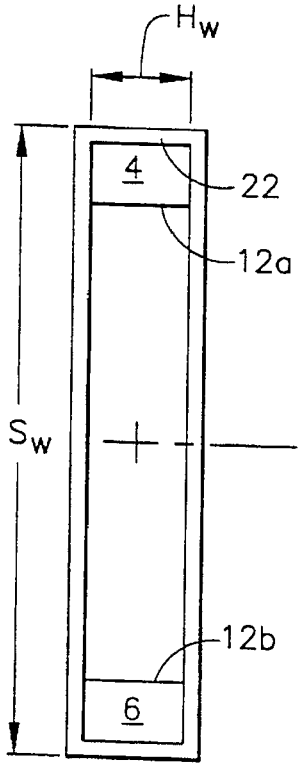
FIG 2A is a diagrammatic, fragmentary end view of a conventional prior art converging-diverging blast nozzle.

FIG. 2A is a diagrammatic, fragmentary end view of nozzle 2, showing exit 22. Walls 4 and 6 can be seen extending to the respective inner locations 12*a* and 12*b* of throat 12. In order to maximize the area blasted per unit time, conventional nozzle 2 makes use of the divergent walls for establishing the blasting swath width, designated Sw in FIG. 2A. This is the distance between contoured walls 4 and 6 at exit 22. As a result of maximizing Sw, the separation distance, Hw in FIG. 2A, becomes minimized, resulting in deleterious boundary layer viscosity interference effects at the diverging portion of contoured walls 4 and 6. Because this distance is minimized, the particle flow is constrained thereby increasing particle to particle impacts, resulting in a decrease in the mass of particles (not shown) flowing through nozzle 2.

The particles will continuously wash the boundary layer from the divergent and side walls creating turbulence with associated particle-to-particle and particle-to-wall collisions and corresponding carbon dioxide particle mass degradation. For a given side support wall separation distance (Hw), this negative impact will increase as supply operating pressure is reduced because of increased dominance of viscous interference.

Figure 2B:
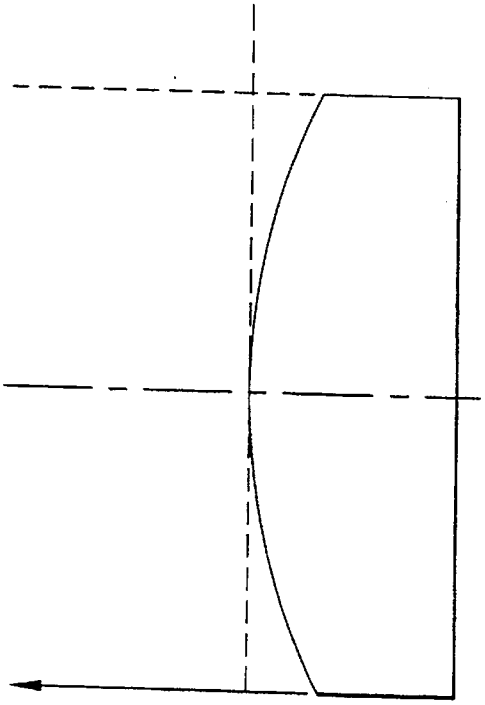
FIG. 2B is a graph showing particle exit velocity as a function of position across the blast swath width.

FIG. 2B, which is aligned with the corresponding structure of FIG. 2A, is a graph showing particle exit velocity as a function of position across the blast swath width of nozzle 2. As can be seen, the velocity is not uniform, with the velocity being maximized at the center, and minimized at the outer edges.

Figure 3:
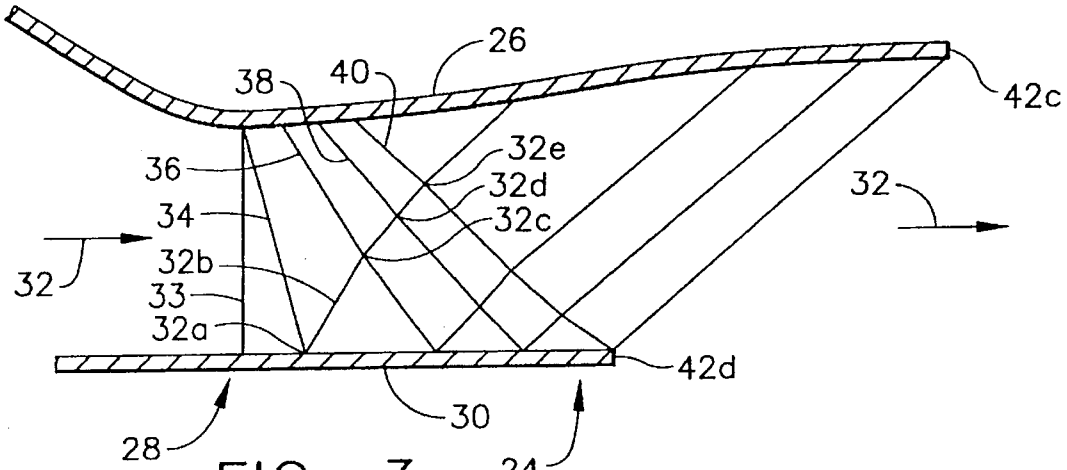
FIG. 3 is a diagrammatic, fragmentary cross-sectional view of a nozzle constructed in accordance with the teachings of the present invention, illustrating multiple expansion waves reflecting off of the solid, flat wall of the nozzle.

FIG. 3 is a diagrammatic, fragmentary cross-sectional view of nozzle 24 which is constructed in accordance with the teachings of the present invention. Nozzle 24 includes contoured wall 26 comprising a converging portion and a diverging portion which meet at throat 28. Wall 26 is spaced apart from solid wall 30, which is generally flat and parallel to the direction of the fluid flow, generally indicated by arrow 32. Although wall 30 is diagrammatically shown as being in both the converging and diverging portions of the internal flow passageway of nozzle 24, it should be appreciated that within the converging portion of the internal flow passageway, wall 30 is not necessarily flat, as discussed below in relation to FIGS. 5 and 5A. Ideally, wall 30 would be slightly angled away from wall 26 in order to open up the cross-sectional area to account for boundary layer build-up. However, for certain blasting applications, the associated increase in manufacturing cost does not warrant the slight rise in added blast performance. The flow convergence portion of nozzle 24 is connected to the delivery hose of a particle blast system. Entrained particles, carbon dioxide pellets in the preferred embodiment, are transported by a transport gas through the delivery hose and delivered to the convergence of nozzle 24. The flow is accelerated to Mach 1 at throat 28 by the converging portion of nozzle 24, and further accelerated beyond Mach 1 by the diverging portion of nozzle 24. The contour of wall 26 is designed in the manner as is well known in the art for producing supersonic flow, typically an analytical method of characteristics defined shape, in conjunction with the operating pressures and exit to throat area ratio. The entrained pellets are carried and accelerated by this flow. The design of nozzle 24 goes beyond just the fluid aerodynamic considerations to include particle carrying fluid physics for maximization of particle velocity and mass across the full blast swath.

As the particles pass from the delivery hose to the convergent portion of the nozzle, the cross-sectional area is dramatically reduced until the minimum passage "throat/choke" area is reached. With conventional nozzles, the side support walls separation distance (Hw) remains constant (FIGS. 1 and 2*a*) and the area is increased via the two symmetric opposing divergent walls. Since the particles have been geometrically moved to the flow centerline in order to pass through the throat, once the particles have reached the divergent portion of the nozzle they tend to remain in the centerline of the flow where flow is at maximum velocity. The overriding mass of the particles reduces the tendency for them to follow the streamlines and thereby distribute evenly across the nozzle. Therefore, even distribution of blast swath particle kinetic energy at the nozzle exit is not possible.

Nozzle 24 provides a superior particle passage due to its more favorable convergent and divergent acceleration characteristics. Because nozzle 24 area distribution is applied at a 90 degree angle compared to the conventional nozzle area distribution, the throat/choke width is significantly wider than conventional nozzles for the same area value. This prevents particles from having to be grouped to the flow centerline to the same extent as with conventional nozzles. This also results in blast swath width (Sw) of nozzle 24 typically being 90 degrees relative to conventional nozzles. Furthermore, the velocity is even across the divergent nozzle passage so flow centerline particle clustering is not aerodynamically promoted. For proper supply pressure and flow rate, nozzle 24 can be designed for convergence in only one dimension, whereas, for the same conditions, the conventional nozzle historically must still rely upon multiple dimensional area change.

Figure 3A:
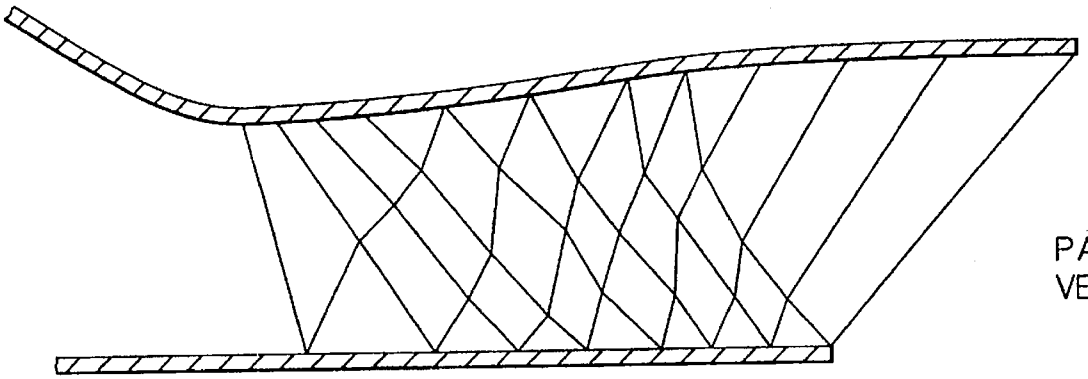
FIG. 3A is a diagrammatic, fragmentary cross-sectional view of a nozzle constructed in accordance with the teachings of the present invention, illustration a MERN with multiple expansion/reflection waves.

Normal shock wave 33 is shown occurring at throat 28. Multiple expansion waves, generally indicated at 34, 36, 38 and 40, are shown in FIG. 3. However, instead of reflecting off of a corresponding expansion wave originating from an opposing contoured wall, the waves reflect off of solid wall 30. For example, wave 34 reflects off of wall 30 at 32*a*. Reflected wave 32*b* intersects waves 36, 38 and 40 at locations 32*c*, 32*d* and 32*e*, respectively. At each intersection, the direction of travel of each wave changes slightly as diagrammatically shown. The embodiment of the present invention diagrammatically illustrated in FIG. 3 is a single expansion reflection nozzle. As will be appreciated, the present invention can also be embodied as a multiple expansion reflection nozzle as shown in FIG. 3A, which diagrammatically illustrates two expansion/reflection waves.

Figure 4A:
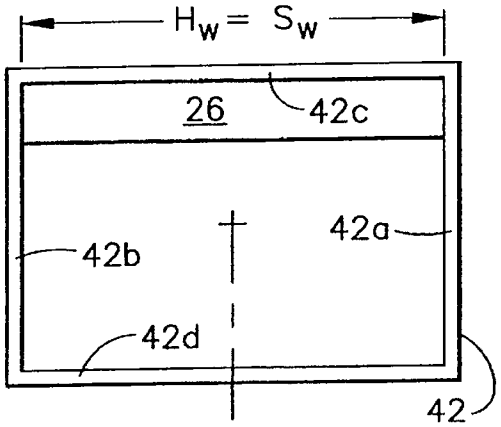
FIG. 4A is a diagrammatic end view of the nozzle of FIG. 3.

As illustrated, nozzle 24 does not rely on reflection of opposing expansion waves reflected off of symmetrically contoured opposing walls, instead relying on reflection from solid wall 30. The solid wall reflection geometry reduces in half the area used for MACH wave expansions and reflections of nozzle 24 in comparison to conventional nozzle 2. With this construction of nozzle 24, maximization of the swath width results in greater side wall separation distance Hw, as seen in FIG. 4A, which is an end view of exit 42 of nozzle 24. In nozzle 24, the swath width depends on the distance between side support walls 42*a* and 42*b*. Side walls 42*a* and 42*b* are preferably inclined slightly to account for boundary layer build up along the length of the diverging portion of the nozzle. Additionally, inclining side walls 42*a* and 42*b* can also be used to effect overexpansion without causing the flow to turn aerodynamically. This, however, would be accompanied by an oblique shock train and particle degradation. For some applications, this effect can be desirable in order to produce a less aggressive blasting effect.

Walls 26 and 30 provide a significant manufacturing benefit in comparison to walls 4 and 6 of nozzle 2. With only one contoured wall, the close tolerance and location must be maintained for only one wall, 26. This avoids more costly advanced manufacturing requirements.

Figure 4B:
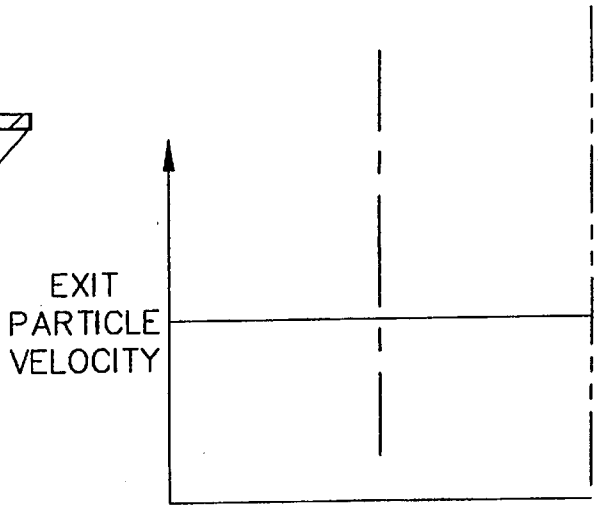
FIG. 4B is a graph showing particle exit velocity as a function of position across the separation distance between the side support walls.

FIG. 4B, which is aligned with the corresponding structure of FIG. 4A, is a graph showing particle exit velocity as a function of position across the separation distance between the side support walls. As can be seen, the velocity is substantially uniform across the entire exit. Nozzle 24 is capable of more effective blast across the entire blast swath in comparison to conventional nozzle 2 (see FIG. 2B).

As FIG. 3 shows, wall 26 extends downstream farther than wall 30. At exit point 42*c*, wall 26 is defined such that the geometry exactly cancels the last reflection off of wall 30 at point 42*d*. Again, aerodynamic theory is applied when designing the nozzle to provide exact Mach wave expansion and reflection with final exit cancellation of waves for shock free flow at a specific system flow supply level. Extension of wall 30 beyond point 42*d* is unnecessary for optimum performance, and may actually degrade blast operation because of added boundary layer area closing effect and oblique shock attachment (which is dependant on system supply levels). A shorter straight wall than required for design point shock free expansion would develop a build up of expansion waves yielding an underexpanded flow field at lower exit Mach number than would otherwise be attained.

Nozzle 24 side walls downstream of the throat may be removed without a great loss in nozzle thrust. However, for particle blasting, the side walls are desirable from the standpoint of providing a confined acceleration flow for maximizing exchange of fluid energy to particle kinetic energy. In addition, the side walls provide the structural support necessary for preventing nozzle geometry damage during routine operation.

Figure 5:
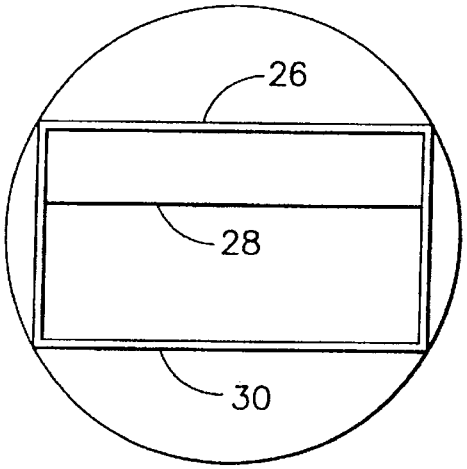
FIG. 5 is a diagrammatic end view of the entrance to the nozzle of FIG. 3 showing the transition from the circular cross-section of the delivery hose to the non-circular cross-section of the nozzle of FIG. 3.

Referring to FIG. 5, there is shown a diagrammatic end view of the entrance to nozzle 24, illustrating the transition from the circular cross-section of the delivery hose to the non-circular cross-section of the nozzle of FIG. 3. As illustrated, this non-circular cross-section is rectangular, although it may be elliptical or other known shapes. As can be seen, the width of the internal passage of nozzle 24 is close to the diameter of the delivery hose (not shown). This minimizes this change in direction, thereby reducing particle to particle impacts. The minimum throat height is also visible in FIG. 5, which, unlike conventional nozzle 2, occurs only at one spot, throat 28. Accordingly, the particle path movement is less constrained by the nozzle walls of nozzle 24, and collision is less likely between particles and with the nozzle walls.

Figure 5A:
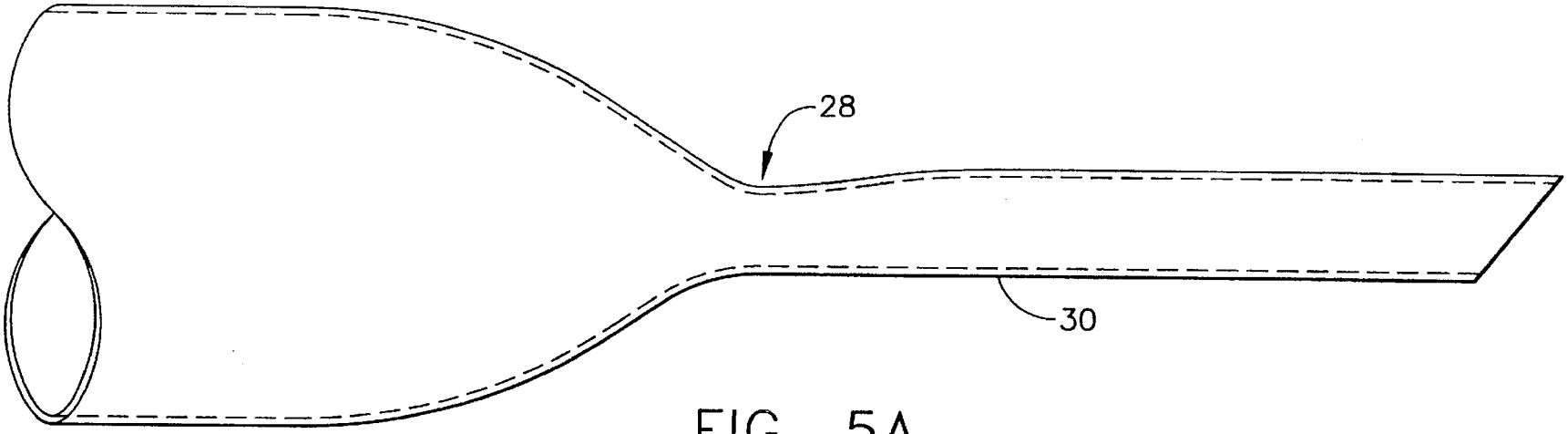
FIG. 5A is a diagrammatic side view of a nozzle according to the present invention.

FIG. 5A diagrammatically shows a side view of a nozzle constructed according to the present invention, clearly showing the converging portion connecting with the diverging portion at the throat, where the internal flow passageway has its minimum cross-section area. The converging portion of the nozzle shown transitions to the cross-sectional shape shown in FIG. 5 by convergence in all the direction of throat height and width, although the convergence in the width direction is preferably as small as possible, as described above in connection to FIG. 5. Downstream of the throat, in the diverging portion, wall 30 is generally flat, as described above.

Figure 6:
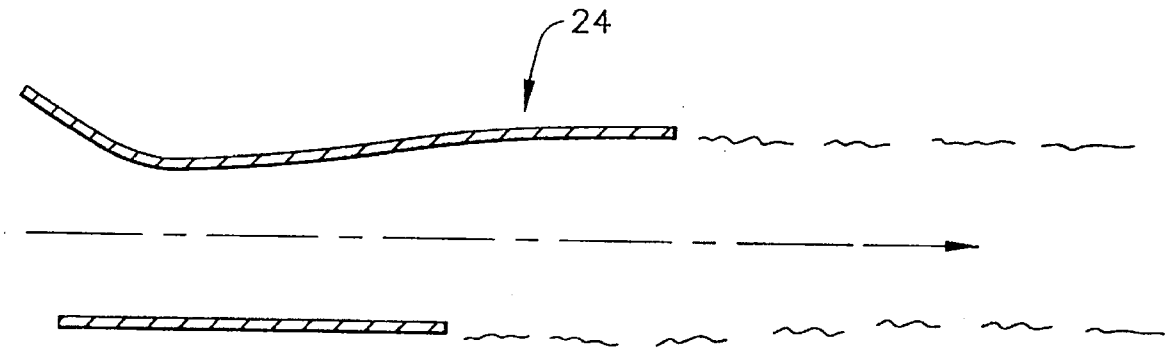
FIG. 6 is a diagrammatic, fragmentary cross-sectional view of the nozzle of FIG. 3 under ideal expansion flow, having no shock waves downstream of the throat.
Figure 7:
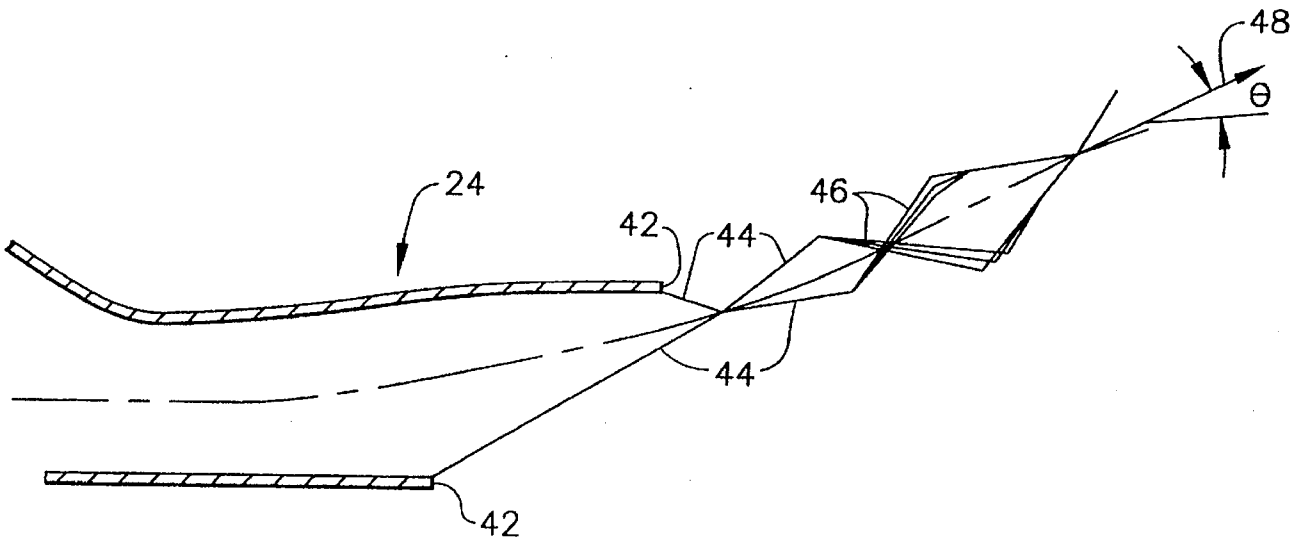
FIG. 7 is a diagrammatic, fragmentary cross-sectional view of the nozzle of FIG. 3 illustrating aerodynamic turning through overexpansion.
Figure 8:
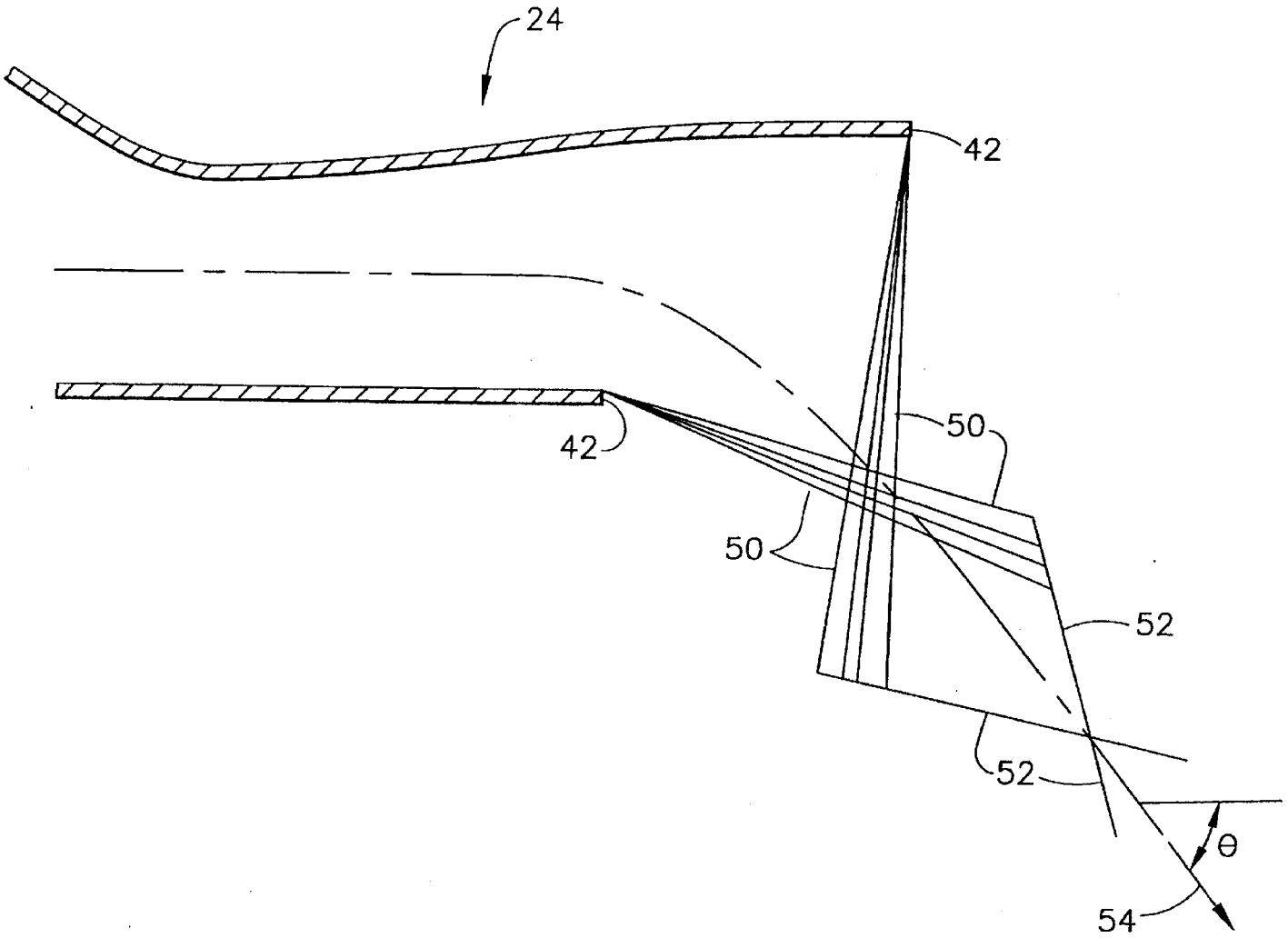
FIG. 8 is a diagrammatic, fragmentary cross-sectional view of the nozzle of FIG. 3 illustrating aerodynamic turning through underexpansion.

The construction of nozzle 24 allows for aerodynamic turning of the flow. FIG. 6, which is a diagrammatic, fragmentary cross-sectional view of nozzle 24 under ideal expansion flow, shows the flow exiting nozzle 24 in a straight path. FIG. 7 illustrates aerodynamic turning with nozzle 24 through overexpansion. Oblique shock waves 44, followed by expansion shock waves 46, are shown occurring downstream of exit 42. The flow direction, indicated generally by arrow 48 has been turned through flow turning angle θ. FIG. 8 illustrates aerodynamic turning with nozzle 24 in the opposite direction from that of FIG. 7, through underexpansion. Expansion waves 50, followed by oblique shock waves 52, are shown occurring downstream of exit 42. The flow direction, indicated generally by arrow 54 has been turned through flow turning angle θ.

The aerodynamic flow turning shown in FIGS. 7 and 8 can be used to turn the flow without redirecting nozzle 22 by merely adjusting the pressure of the transport fluid to either underexpand or overexpand the nozzle. This can allow the flow to reach hard to reach locations. Additionally, with nozzle 22, if the flow is not exiting straight, as shown in FIG. 6, it is an immediate indication that it is either over or under expanded. With this direct visual feedback, the user may adjust supply pressure to operate closer to the nozzle design point to attain more precisely maximum blasting performance.

By using a nozzle constructed in accordance with the teachings of the present invention, it is possible to operate the particle blast system at lower pressures while achieving the same or better blast effect. For example, particle blast systems using conventional prior art nozzles frequently were operated with transport gas pressures in the range of 250 PSIG to 300 PSIG. When the particle blast systems are used with nozzles of the present invention, the transport gas pressure can be significantly lower, such as 80 PSIG, yet yield the same or better blast effect. The lower pressure reduces the decibel level produced by the blasting system, and also allows the use of shop air, rather than relying on high pressure compressors.

In summary, numerous benefits have been described which result from employing the concepts of the invention. The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

I claim:

1. A nozzle for use with a particle blast system comprising:

(a) an internal flow passageway including a converging portion, a diverging portion and a throat intermediate said converging and diverging portions, said flow passageway defining a flow path within said nozzle, said flow path having a direction of flow associated therewith;

(b) said diverging portion of said flow passageway being defined by first and second spaced apart opposing walls, said first wall being generally flat and generally parallel to said direction of flow, said second wall being configured to produce supersonic flow when fluid flows through said diverging portion of said flow passageway at a predetermined pressure and flow rate.

2. The nozzle according to claim 1, wherein said diverging portion comprises third and fourth walls spaced apart from each other and extending between said first and second walls.

3. The nozzle according to claim 1, wherein said throat has a non-circular cross-section.

4. The nozzle according to claim 3, wherein said throat has a generally rectangular cross-section.

5. The nozzle according to claim 3, wherein said throat has a generally elliptical cross-section.

6. The nozzle according to claim 1 wherein said nozzle includes an exit downstream of said throat, and wherein said first and second walls include respective distal ends adjacent said exit, said distal end of said second wall being disposed further downstream than said distal end of said first wall such that said exit is oblique to said direction of flow.

7. The nozzle according to claim 1 wherein a plurality of expansion waves are formed within said flow passageway which originate at said second wall and which reflect off of said first wall.

8. The nozzle according to claim 1 wherein said nozzle is a single expansion reflection nozzle.

9. The nozzle according to claim 1 wherein said nozzle is a multiple expansion reflection nozzle.

10. A particle blast system comprising:

(a) a source of particles;

(b) a nozzle including:

(i) an internal flow passageway including a converging portion, a diverging portion and a throat intermediate said converging and diverging portions, said flow passageway defining a flow path within said nozzle, said flow path having a direction of flow associated therewith;

(ii) said diverging portion of said flow passageway being defined by first and second spaced apart opposing walls, said first wall being generally flat and generally parallel to said direction of flow, said second wall being configured to produce supersonic flow when fluid flows through said diverging portion of said flow passageway at a predetermined pressure and flow rate; and (c) a transport system configured to transport said particles to said nozzle for discharge therefrom.

11. A method for discharging particles from a particle blast system comprising:

(a) providing a source of particles;

(b) providing a nozzle, said nozzle including:

(i) an internal flow passageway including a converging portion, a diverging portion and a throat intermediate said converging and diverging portions, said flow passageway defining a flow path within said nozzle, said flow path having a direction of flow associated therewith;

(ii) said diverging portion of said flow passageway being defined by first and second spaced apart opposing walls, said first wall being generally flat and generally parallel to said direction of flow, said second wall being configured to produce supersonic flow when fluid flows through said diverging portion of said flow passageway at a predetermined pressure and flow rate; and (c) flowing a fluid with said particles entrained therein to and through said nozzle and discharging said fluid and entrained particles from said nozzle.

12. The method of claim 11 comprising overexpanding or underexpanding said fluid flow through said nozzle to vary the direction of said fluid and entrained particles discharged from said nozzle.

13. The method of claim 11 wherein said particles are made of a material which sublimates under ambient conditions.

14. The method of claim 13 wherein said particles are solid carbon dioxide.

15. A nozzle for use with a particle blast system comprising:

(a) an internal flow passageway including a converging portion, a diverging portion, and a throat intermediate said converging and diverging portions, said flow passageway defining a flow path within said nozzle, said flow path having a direction of flow associated therewith;

(b) said diverging portion of said flow passageway being defined by first and second spaced apart opposing walls, said first wall being generally flat, said second wall being configured to produce supersonic flow when fluid flows through said diverging portion of said flow passageway at a predetermined pressure and flow rate;

(c) an exit disposed downstream of said throat; and (d) said first and second walls include respective distal ends adjacent said exit, said distal end of said second wall being disposed further downstream than said distal end of said first wall such that said exit is oblique to said direction of flow.

16. The nozzle according to claim 15, wherein said diverging portion comprises third and fourth walls spaced apart from each other and extending between said first and second walls.

17. The nozzle according to claim 15, wherein said throat has a non-circular cross-section.

18. The nozzle according to claim 17, wherein said throat has a generally rectangular cross-section.

19. The nozzle according to claim 17, wherein said throat has a generally elliptical cross-section.

20. The nozzle according to claim 15 wherein a plurality of expansion waves are formed within said flow passageway which originate at said second wall and which reflect off of said first wall.

21. The nozzle according to claim 15 wherein said nozzle is a single expansion reflection nozzle.

22. The nozzle according to claim 15 wherein said nozzle is a multiple expansion reflection nozzle.

23. A particle blast system comprising:

(a) a source of particles;

(b) a nozzle including:

(i) an internal flow passageway including a converging portion, a diverging portion, and a throat intermediate said converging and diverging portions, said flow passageway defining a flow path within said nozzle, said flow path having a direction of flow associated therewith;

(ii) said diverging portion of said flow passageway being defined by first and second spaced apart opposing walls, said first wall being generally flat, said second wall being configured to produce supersonic flow when fluid flows through said diverging portion of said flow passageway at a predetermined pressure and flow rate;

(iii) an exit disposed downstream of said throat; and (iv) said first and second walls include respective distal ends adjacent said exit, said distal end of said second wall being disposed further downstream than said distal end of said first wall such that said exit is oblique to said direction of flow; and (c) a transport system configured to transport said particles to said nozzle for discharge therefrom.

24. A method for discharging particles from a particle blast system comprising:

(a) providing a source of particles;

(b) providing a nozzle, said nozzle including:

(i) an internal flow passageway including a converging portion, a diverging portion, and a throat intermediate said converging and diverging portions, said flow passageway defining a flow path within said nozzle, said flow path having a direction of flow associated therewith;

(ii) said diverging portion of said flow passageway being defined by first and second spaced apart opposing walls, said first wall being generally flat, said second wall being configured to produce supersonic flow when fluid flows through said diverging portion of said flow passageway at a predetermined pressure and flow rate;

(iii) an exit disposed downstream of said throat; and (iv) said first and second walls include respective distal ends adjacent said exit, said distal end of said second wall being disposed further downstream than said distal end of said first wall such that said exit is oblique to said direction of flow; and (c) flowing a fluid with said particles entrained therein to and through said nozzle and discharging said fluid and entrained particles from said nozzle.

25. The method of claim 24 comprising overexpanding or underexpanding said fluid flow through said nozzle to vary the direction of said fluid and entrained particles discharged from said nozzle.

26. The method of claim 24 wherein said particles are made of a material which sublimates under ambient conditions.

27. The method of claim 26 wherein said particles are solid carbon dioxide.

28. A method for discharging particles from a particle blast system comprising:

(a) providing a source of particles;

(b) providing a nozzle, said nozzle including:

(i) an internal flow passageway including a converging portion, a diverging portion and a throat intermediate said converging and diverging portions, said flow passageway defining a flow path within said nozzle;

(ii) said diverging portion of said flow passageway being defined by first and second spaced apart opposing walls, said first wall being generally flat, said second wall being configured to produce supersonic flow when fluid flows through said diverging portion of said flow passageway at a predetermined pressure and flow rate;

(c) flowing a fluid with said particles entrained therein to and through said nozzle and discharging said fluid and entrained particles from said nozzle; and (d) overexpanding or underexpanding said fluid flow through said nozzle to vary the direction of said fluid and entrained particles discharged from said nozzle.

29. The method of claim 28 wherein said particles are made of a material which sublimates under ambient conditions.

30. The method of claim 29 wherein said particles are solid carbon dioxide.

* * * * *